US006470259B1

(12) United States Patent
Round

(10) Patent No.: US 6,470,259 B1
(45) Date of Patent: Oct. 22, 2002

(54) ELECTRONIC THROTTLE CONTROL SYSTEM

(75) Inventor: David Christopher Round, Saline, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/696,466

(22) Filed: Oct. 25, 2000

(51) Int. Cl.[7] ..... F02D 41/22
(52) U.S. Cl. ..... 701/112; 701/114; 123/397
(58) Field of Search ..... 701/107, 110, 701/112, 114, 115; 123/350, 359, 397

(56) References Cited

U.S. PATENT DOCUMENTS 5,966,305 A * 10/1999 Watari et al. ..... 700/82
6,125,322 A * 9/2000 Bischof et al. ..... 701/114

FOREIGN PATENT DOCUMENTS

DE 197 57 334 A1 * 7/1999

* cited by examiner

*Primary Examiner*—Andrew M. Dolinar

(57) ABSTRACT

An electronic throttle control apparatus includes a powertrain control module having at least two microprocessors. The powertrain control module is coupled to controls an internal combustion engine and an electronic throttle. A main microprocessor is located in the powertrain control module that includes control logic operative to monitor and control the internal combustion engine. A secondary microprocessor is also located in the powertrain control module and is in communication with the main microprocessor. The secondary microprocessor control throttle plate position, while interrogating the main microprocessor to verify correct execution of throttle control software in the main microprocessor. If a malfunction is detected, then the secondary microprocessor disables the internal combustion engine.

2 Claims, 1 Drawing Sheet

ELECTRONIC THROTTLE CONTROL SYSTEM

TECHNICAL FIELD

The present invention relates generally to control systems for internal combustion engines, and more particularly, to an electronic throttle control system.

BACKGROUND ART

Many previously known motor vehicle throttle controls have a direct physical linkage between an accelerator pedal and the throttle body so that the throttle plate is pulled open by the accelerator cable as the driver depresses the pedal. The direct mechanical linkage includes biasing that defaults the linkage to a reduced operating position, in a manner consistent with engine operation. Nevertheless, such mechanisms are often simple and unable to offer optimal fuel consumption, emissions efficiency and performance to changing traveling conditions.

An alternative control for improving throttle control and the efficient introduction of fuel air mixtures into the engine cylinders is presented by electronic throttle controls. The electronic throttle control includes a throttle control unit that positions the throttle plate by an actuator controlled by a microprocessor based on the current operating state determined by sensors. The processors are often included as part of a powertrain electronic control that can adjust the fuel air intake and ignition in response to changing conditions of engine vehicle operation as well as operator control. Protection may be provided so that an electronic system does not misread or misdirect the control and so that unintended operation is avoided if portions of the electronic control system were to suffer a failure.

Typical electronic throttle control systems require the use of multiple controllers. This is done because existing microprocessor based powertrain control modules do not have the chronometric/performance capability to perform the additional function of electronic throttle control. Unfortunately, adding multiple controllers adds to overall system cost and complexity while reducing reliability.

The disadvantages associated with these conventional electronic throttle control techniques have made it apparent that a new technique for electronic throttle control is needed. The new technique should require only one additional controller for both powertrain and electronic throttle control. Additionally, the new technique should reduce overall system cost and complexity while improving reliability. The present invention is directed to these ends.

SUMMARY OF THE INVENTION

It is, therefore, an object of the invention to provide an improved and reliable electronic throttle control system. Another object of the invention is to require only one controller for both powertrain and electronic throttle control. An additional object of the invention is to reduce overall system cost and complexity while improving reliability.

In accordance with the objects of this invention, an electronic throttle control system is provided. In one embodiment of the invention, an electronic throttle control apparatus includes a powertrain control module having at least two microprocessors. The powertrain control module is coupled to controls an internal combustion engine and an electronic throttle. A main microprocessor is located in the powertrain control module that includes control logic operative to monitor and control the internal combustion engine and derive the desired throttle position. A secondary microprocessor is also located in the powertrain control module and is in communication with the main microprocessor. The secondary microprocessor controls throttle plate position, while interrogating the main microprocessor to verify correct execution of throttle control monitoring software in the main microprocessor. If a malfunction is detected, then the secondary microprocessor can disable the internal combustion engine by overriding the main microprocessor's control of the engine.

The present invention thus achieves an improved electronic throttle control system. The present invention is advantageous in allows the use of only one controller for both powertrain control functions and electronic throttle control.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODES FOR CARRYING OUT THE INVENTION

Figure 1:
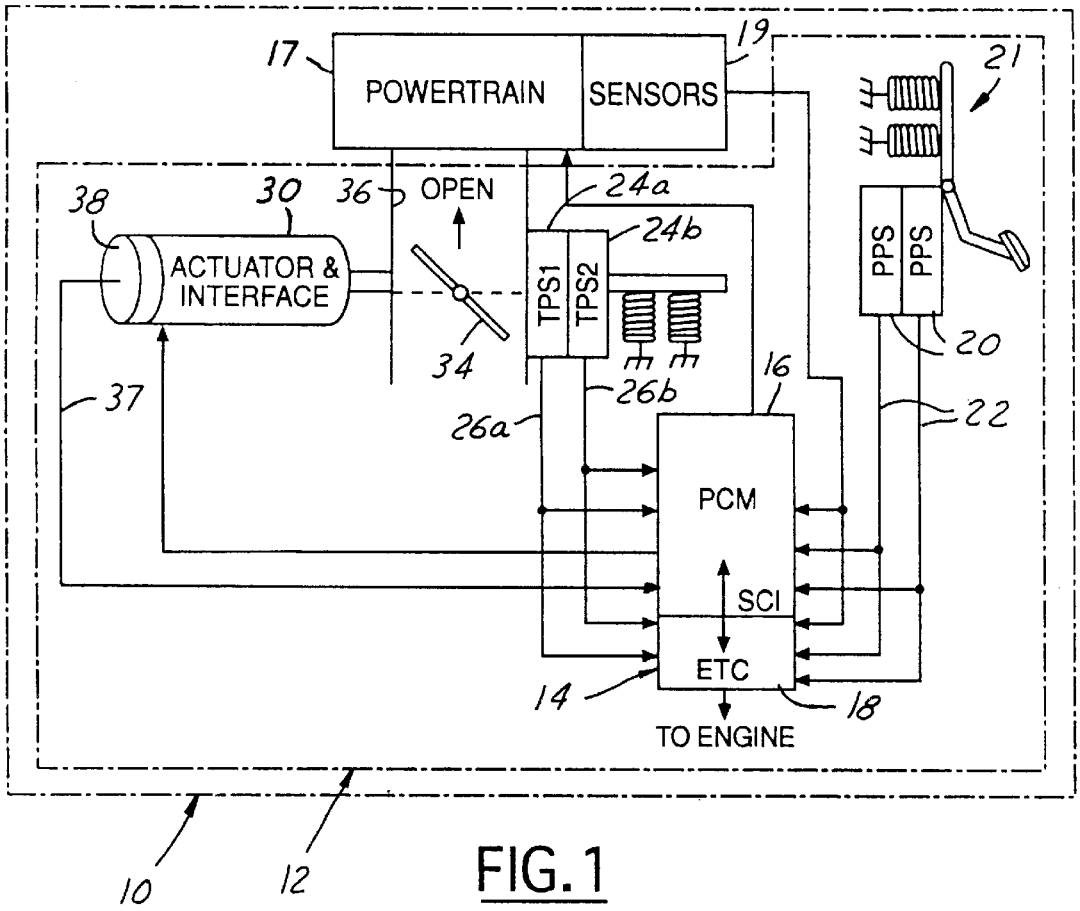
FIG. 1 is an electronic throttle control system in accordance with one embodiment of the present invention.

In the following figures, the same reference numerals will be used to identify identical components in the various views. The present invention is illustrated with respect to an electronic throttle control system, particularly suited for the automotive field. However, the present invention is applicable to various other uses that may require electronic throttle control systems.

Referring to FIG. 1, a motor vehicle powertrain system 10 including electronic throttle control system 12 includes an electronic control unit 14. In the preferred embodiment, the electronic control unit 14 includes a powertrain control module (PCM) 16 including a main processor and an electronic throttle control (ETC) 18 including an independent processor. The PCM and ETC share sensors 19 and actuators that are associated with the powertrain system 17 and control module 16. Preferably, the electronic throttle control (ETC) 18 includes a processor physically located within the powertrain control module housing, although a separate housing, separate locations and other embodiments can also be employed in practicing the invention. Moreover, while the electronic throttle controller 18 and the powertrain control module 16 have independent processors, they share the inputs and outputs of powertrain sensors 19, 26 for independent processing.

A wide variety of inputs are represented in the FIG. 1 diagram by the diagrammatic representation of two or more redundant pedal position sensors 20. The sensors 20 are coupled through inputs 22 and are representative of many different driver controls that may demonstrate the demand for power. In addition, the electronic control unit 14 includes inputs 26*a* and 26*b* for detecting throttle position. A variety of ways for providing such indications is diagrammatically represented in FIG. 1 by a first throttle position sensor 24*a* and a redundant second throttle position sensor 24*b* to obtain an actual throttle position indication. As a result of the many inputs represented at 19, 22, 26*a* and 26*b*, the electronic controller 14 provides outputs for limiting output power so that output power does not exceed power demand. A variety of outputs are also diagrammatically represented in FIG. 1 by the illustrated example of outputs to an actuator and motive interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback. For example, the motor position sensor 38 or the throttle position sensors 24*a* and 24*b* may provide feedback to the powertrain control module 16, as shown at 37, 26*a* and 26*b*, respectively, to determine whether alternative responses are required or to maintain information for service or repair.

The purpose of the present invention is to provide a method of implementing electronic throttle control as an add-on to an existing microprocessor based powertrain control module 16 whilst meeting all the requirements for throttle performance and monitoring for a safety related system. This method of implementing this function is particularly useful where the powertrain microprocessor does not have the chronometric/performance capability to perform this additional control function. The present invention utilizes a secondary microprocessor that contains two independent co-located control software functions. The first function is a throttle plate position control of an external motor drive circuit. The second function is powertrain control microprocessor interrogation to verify correct execution of software in the main microprocessor that monitors the desired electronic throttle control angle calculations. A third function may also be added to the secondary microprocessor to provide a gross check of the main microprocessors desired throttle plate angle calculations.

In an alternative implementation of the present invention, the first and second functions may be partitioned into two separate microprocessors. Along these lines, the first function may be performed in the main microprocessor, while the second function uses a dedicated secondary microprocessor.

The Electronic Throttle Control (ETC) microprocessor performs two major functions. The first is to control the throttle plate position by regulating the motor driver circuit to achieve the desired throttle position based on the desired position command from the main powertrain control microprocessor. The second is to verify that the ETC monitor software in the main microprocessor is executing correctly by using a shared serial communications link to request the main micro to perform calculations based on seeds supplied by the ETC microprocessor. The main microprocessor has to perform these calculations and report back to the ETC microprocessor within a set time. The ETC microprocessor then compares the data supplied with its own calculated or looked-up value. If there is any discrepancy then the ETC microprocessor will override the main microprocessor injector control signals to disable and shutdown the engine.

The present invention thus achieves an improved and reliable electronic throttle control system by integrating powertrain functions and electronic throttle functions into one controller. In this way, the present invention reduces overall system cost and complexity while improving reliability.

From the foregoing, it can be seen that there has been brought to the art a new and improved electronic throttle control system. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. An electronic throttle control apparatus comprising:

a powertrain control module coupled to and controlling an internal combustion engine, said powertrain control module also coupled to and controlling an electronic throttle;

a main microprocessor located in said powertrain control module, said main microprocessor including control logic operative to monitor and control said internal combustion engine; and a secondary microprocessor located in said powertrain control module and in communication with said main microprocessor, said secondary microprocessor having control logic operative to command an external motor drive circuit to control a throttle plate position, interrogate said main microprocessor to verify correct execution of throttle control software, and override said main microprocessor to disable said internal combustion engine when said main microprocessor malfunctions.

2. The apparatus as recited in claim 1, wherein said secondary microprocessor further includes control logic operative to provide a gross check of desired throttle plate angle calculations provided by said main microprocessor.

* * * * *